United States Patent [19]

Plocek et al.

[11] Patent Number: 5,002,497

[45] Date of Patent: Mar. 26, 1991

[54] FLOATABLE PANEL MOUNTABLE ELECTRICAL CONNECTOR ASSEMBLY

[75] Inventors: Edward J. Plocek, Lisle; Bill B. Wilson, Montgomery; Thomas G. Premo, West Chicago, all of Ill.

[73] Assignee: Molex Incorporated, Lisle, Ill.

[21] Appl. No.: 470,482

[22] Filed: Jan. 26, 1990

[51] Int. Cl.[5] ..... H01R 13/629

[52] U.S. Cl. ..... 439/248; 439/247; 439/557

[58] Field of Search ..... 439/246–248, 439/544, 557

[56] References Cited

U.S. PATENT DOCUMENTS

| | | | |
|---|---|---|---|
| 3,569,909 | 3/1971 | Garver | 439/557 X |
| 3,989,343 | 11/1976 | Lucius et al. | 439/557 |
| 4,909,748 | 3/1990 | Kozono et al. | 439/247 |

*Primary Examiner*—Eugene F. Desmond

*Attorney, Agent, or Firm*—Louis A. Hecht; Stephen Z. Weiss; Charles S. Cohen

[57] ABSTRACT

An electrical connector assembly is provided including a panel mountable connector that can float relative to a mounting aperture in the panel and that is self-alignable relative to the mounting aperture. The floating connector includes a generally rectangular housing having a mounting flange extending outwardly therefrom. The connector further includes clusters of deflectable beams extending from each side. The deflectable beams include a locking beam having a locking projection for engaging a side of the panel opposite the side engaged by the panel. Each cluster further includes a pair of deflectable centering beams for centering and rotationally aligning the connector to the mounting aperture in the panel.

15 Claims, 3 Drawing Sheets

FLOATABLE PANEL MOUNTABLE ELECTRICAL CONNECTOR ASSEMBLY

BACKGROUND OF THE INvENTION

Panel mountable electrical connectors comprise a housing having at least one electrically conductive terminal therein. The housing typically comprises nonconductive material, and may be partly or entirely molded from plastic. The housing of the panel mountable electrical connector includes a mating end with structure that permits repeated mating and unmating with a second electrical connector. The second electrical connector may be mounted to wires, a cable, a circuit board or a second panel.

The panel mountable electrical connector further includes means for mounting the connector to an aperture in a panel. Many prior art connectors of this general type have included separate means for achieving secure mounting to the panel. For example, the connector housing on such prior art connectors may include a flange which exceeds the cross-sectional dimensions of the mounting aperture in the panel. A smaller portion of the connector housing will extend through the mounting aperture in the panel and will be engageable with separate retaining means, such as a nut or a clip engageable against the opposed side of the panel. A portion of the panel will thus be locked between the flange of the connector housing and the separable retaining means.

Other prior art panel mountable electrical connector housings have included integral latches that lockingly engage the panel, thereby avoiding the need to employ separate panel engaging means with the electrical connector housing. In this regard, it is desirable to minimize the number of components employed in an electrical connector housing to reduce costs, to facilitate assembly and to avoid inventory control problems.

Many electrical connectors are employed in blind mating environments where precise alignment of the connectors during mating cannot always be assured. For example, a panel mountable electrical connector may be disposed at a relatively inaccessible location in an automotive vehicle, a photostatic copier or a computer. An attempt to mate improperly aligned connectors can result in substantial damage to one or both connectors and/or to the fragile electrically conductive terminals mounted therein. Furthermore, the forces encountered by a technician during an attempt to mate improperly aligned connectors can be interpreted by the technician as an indication of complete mating. Thus, mating forces may be terminated prior to achieving complete mating, thereby resulting in a poor quality electrical connection or no electrical connection at all.

Many prior art panel mountable electrical connectors intended for blind mating applications have been provided with structure to achieve a floating mount of the connector to the panel. A floating mount generally is achieved by having a panel mounting aperture with dimensions that exceed the dimensions of portions of the connector housing passing through the panel. The mounting means employed on such floating panel mount connectors are constructed to prevent separation of the connector from the panel, but to permit relative float therebetween. Some floating panel mountable connectors only permit float of the connector within the plane of the panel. Other prior art floating panel mountable connectors also permit angular float of the connector about an axis disposed in the plane of the panel. Angular float is acceptable in some instances, but in many other instances angular float will misalign terminals during early stages of mating, and thus may damage the terminals.

Most prior art floating panel mountable connectors include biasing means for approximately centering the connector housing relative to the aperture in the panel and/or angularly realigning the connector into a position where the mating axis of the connector is substantially orthogonal to the plane of the panel. Many of these prior art floating panel mountable connectors employ separate biasing means. However, the prior art does include floating panel mount connectors wherein the biasing means is unitary with the housing. Examples of prior art floating panel mountable connectors with integral panel engagement and biasing means include: U.S. Pat. No. 3,989,343 which issued to Lucius et al. on Nov. 2, 1976; U.S. Pat. No. 4,168,874 which issued to Weidler et al. on Sept. 25, 1979; U.S. Pat. No. 4,815,984 which issued to Sugiyama et al. on Mar. 28, 1989 and U.S. Pat. No. 4,840,584 which issued to Cox on June 20, 1989.

In addition to providing electrical connectors that can float relative to a panel and that can achieve some degree of centering, it is now considered desirable to provide an electrical connector that can positively and accurately center itself in the mounting aperture of a panel, and that can further achieve self-alignment about the mating axis extending substantially orthogonal to the plane of the panel. This is particularly important, for example, where a printed circuit board having at least one connector mounted thereto is being mated to at least one panel mounted electrical connector under blind mating conditions. In these situations, the available space may limit visibility of the connectors and may further limit the ability to accurately align the printed circuit board to the panel. The existence of several connectors on the panel and/or the circuit board may further complicate alignment during mating and unmating.

It is now also considered desirable to provide panel mountable self-aligning and self-centering connectors that can readily be mounted to or removed from a panel even in situations where only the front of the panel is accessible. The above referenced prior art connectors with integral centering means generally are not well suited for removal from the panel, and most require destruction of the connector and/or damage to the panel to effect removal.

In view of the above, it is an object of the subject invention to provide a panel mountable electrical connector assembly that can float in all radial directions within the plane of the panel during mating.

It is another object of the subject invention to provide a panel mountable electrical connector assembly that will positively and accurately align itself with respect to all axes prior to each mating and after each unmating.

It is an additional object of the subject invention to provide an electrical connector that will achieve proper rotational alignment of the connector about the mating axis of the connector.

Still another object of the subject invention is to provide a floating panel mount electrical connector having a unitarily molded housing.

Still a further object of the subject invention is to provide an efficient floating panel mount connector that can readily be mounted to a panel and that can readily selectively be removed therefrom.

SUMMARY OF THE INVENTION

The subject invention is directed to a connector assembly comprising a floating panel mountable connector that permits float of the connector relative to a panel during mating, while simultaneously assuring accurate alignment of the connector in the panel prior to each mating.

The panel mountable connector of the subject invention includes a nonconductive housing which may be unitarily molded from a suitable plastic material. The housing includes a forward mating end and a rearward conductor receiving end, with at least one terminal receiving cavity extending therebetween. In most embodiments, a plurality of terminal receiving cavities will extend between the opposed forward and rearward ends of the housing for receiving a corresponding plurality of electrically conductive terminals. The terminals mounted in the housing may take any of a great variety of different forms. A preferred terminal design is shown in copending patent application Ser. No. 225,001 and in copending application Ser. No. 314,992.

The housing preferably is of substantially rectangular cross-sectional configuration with opposed substantially parallel top and bottom walls and opposed substantially parallel side walls connected to and extending between the top and bottom walls respectively. The housing may further include a panel engaging flange extending outwardly therefrom. The panel engaging flange preferably is substantially rigid with respect to the top, bottom and side walls of the housing and preferably is unitarily molded therewith. The flange preferably extends from the top, bottom and side walls of the housing a sufficient distance to positively prevent passage of the housing through the associated mounting aperture in the panel. This objective can be achieved by dimensioning the flange such that the extension of the flange plus the height or width dimension of the connector housing exceeds the corresponding height or width of the mounting aperture in the panel. Thus the connector will be substantially prevented from passing through the panel for any of the extreme float positions of the connector housing relative to the mounting aperture in the panel. The flange may be of segmented form about the periphery of the electrical connector housing to provide for panel engagement and self-centering latches as explained further herein. At least one segment of the flange may include polarization means for engagement with corresponding polarization means on the panel.

The electrical connector housing of the subject invention further includes a plurality of arrays of independently deflectable panel engaging means. The panel engaging means may comprise deflectable cantilevered beams extending from the housing for engaging regions of the panel in proximity to the mounting aperture therein. Preferably, the beams all extend forwardly from a rearward portion of the housing toward the panel engaging flange of the housing. At least selected deflectable beams may extend intermediate segments of the above described segmented flange.

In a preferred embodiment each array of panel engaging means may comprise a plurality of deflectable beams. At least one beam in each such array may define a locking beam disposed to engage a face of the panel opposite a face thereof engaged by the flange. At least one additional deflectable cantilevered beam may define a centering beam disposed to engage an edge portion of the panel defining the mounting aperture therein. The deflectable panel engaging locking beams prevent unintended removal of the electrical connector from the panel. Deflectable panel engaging centering beams function to center and align the electrical connector in the mounting aperture of the panel.

In preferred embodiments, as described and illustrated herein, arrays of deflectable panel engaging means extend from each of the top, bottom and opposed side walls of the connector housing. Each such array may comprise at least three deflectable panel engaging beams. A plurality of the beams in each array are centering beams which are disposed and dimensioned to exert centering and angular alignment forces against edge regions of the mounting aperture in the panel. At least one deflectable panel engaging beam in each such array is a locking beam which may include an outwardly extending projection for lockingly engaging a surface of the panel. In particular, each such projection may include a forwardly facing locking edge for engaging the rear surface of the panel and a rearwardly facing ramped edge to generate deflection in the locking beam during the forward-to-rearward mounting of the connector into the mounting aperture of the panel. The deflectable locking beam may be disposed intermediate the centering beams. The locking beam may further be dimensioned and configured to contribute to the centering forces exerted against the edge regions of the panel defining the mounting aperture. The deflectable locking beam may be cantilevered from a location spaced further from the panel than the centering beams are. The additional cantilevered length provided on the deflectable locking beam facilitates the deflection that is required during mounting of the connector to the panel and also facilitates deflection to enable easy removal of the connector from the panel. Conversely the relatively short length of the centering beams enables the generation of greater centering forces.

The panel mountable connector of the subject invention can readily be mounted to the panel by merely urging the connector rearwardly into the mounting aperture of the panel to generate the required deflection in the locking beams. The connector can similarly be removed from the panel by merely deflecting the locking beams inwardly a sufficient amount to enable the locking projections to clear the edges defining the mounting aperture of the panel. In use the various beams enable efficient radial float, but resist rotational float about an axis within the plane of the panel.

The connector assembly may further comprise a second connector having a flared mating end for generating ramping forces to enable the float of the above described panel mountable connector during mating. The flared mating end of the second connector is dimensioned to ensure sufficient float of the panel mountable connector to achieve proper mating alignment prior to actual mating of the terminals. The second connector may be a printed circuit board mountable connector with means for rigid mounting to the circuit board.

DETAILED DESCRIPTION OF THE PREFERRED EMBODIMENT

Figure 1:
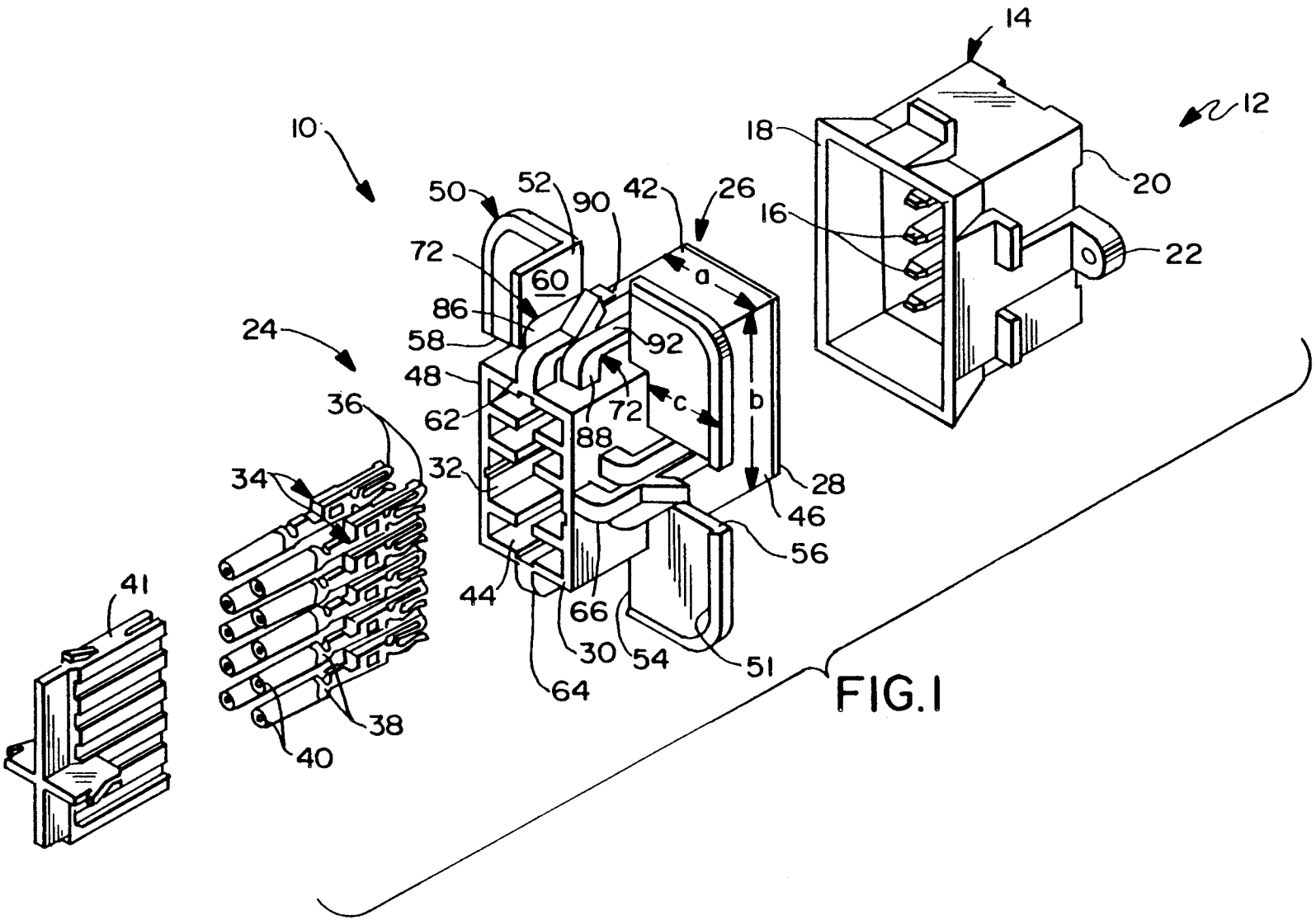
FIG. 1 is an exploded perspective view of an electrical connector assembly in accordance with the subject invention.
Figure 2:
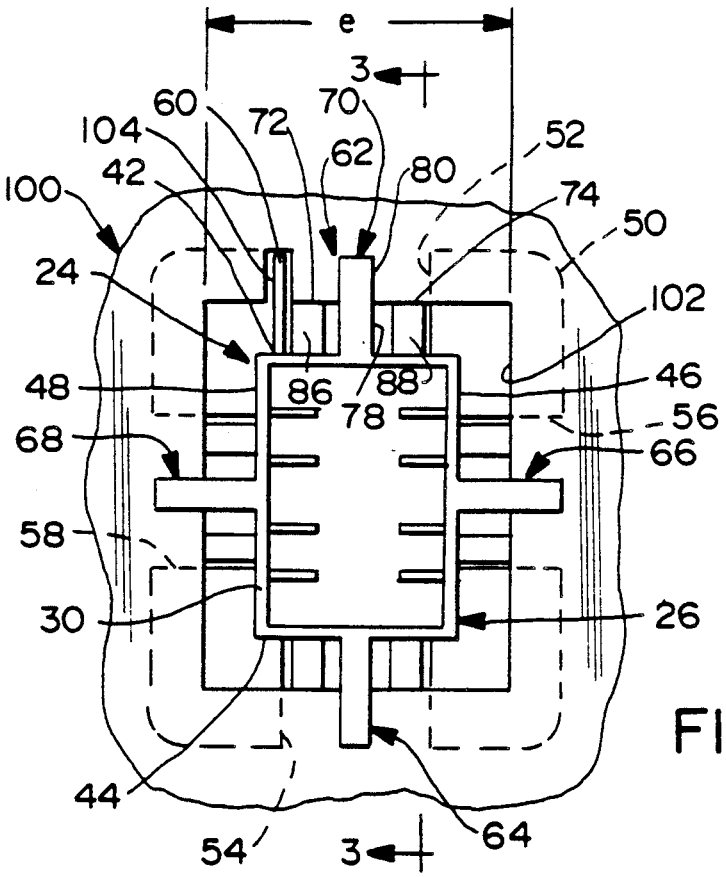
FIG. 2 is a rear elevational view of the panel mounted connector.
Figure 3:
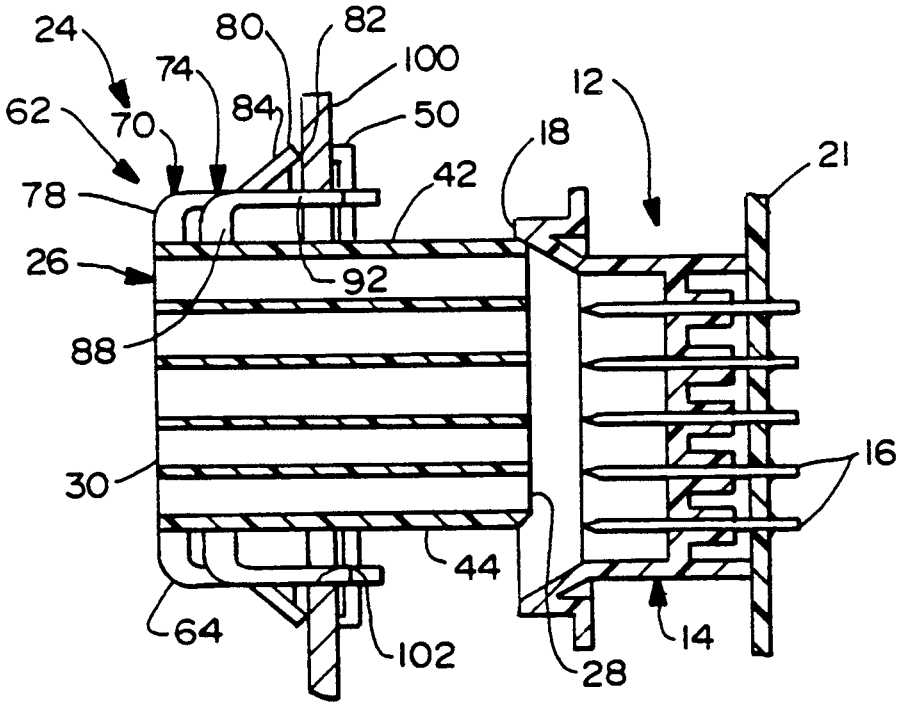
FIG. 3 is a cross-sectional view taken along line 3–3 in FIG. 2, and showing the connector assembly prior to mating.
Figure 4:
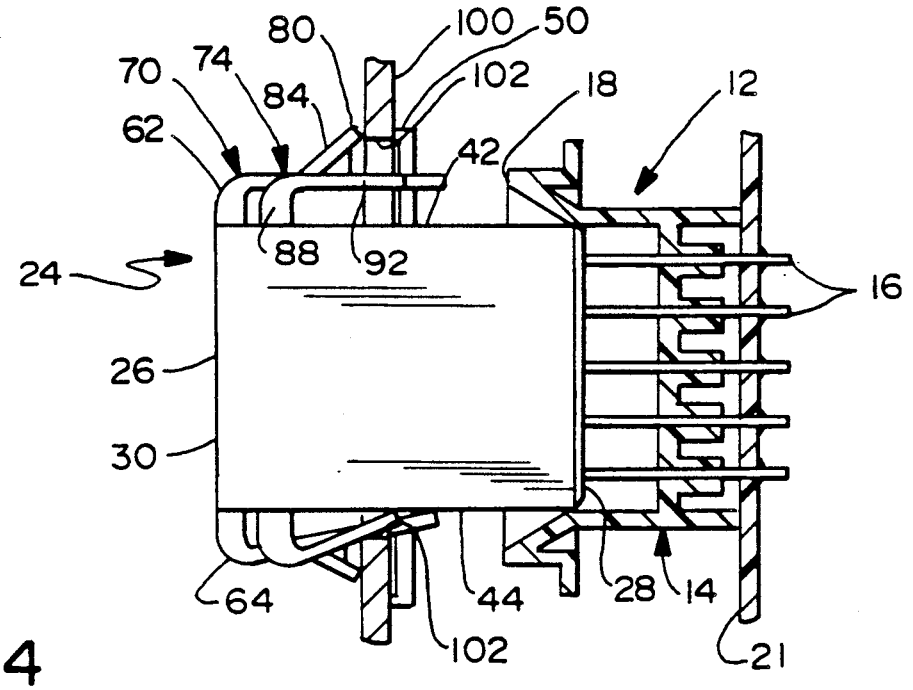
FIG. 4 is a cross-sectional view similar to FIG. 3 but showing the electrical connector assembly during mating.
Figure 5:
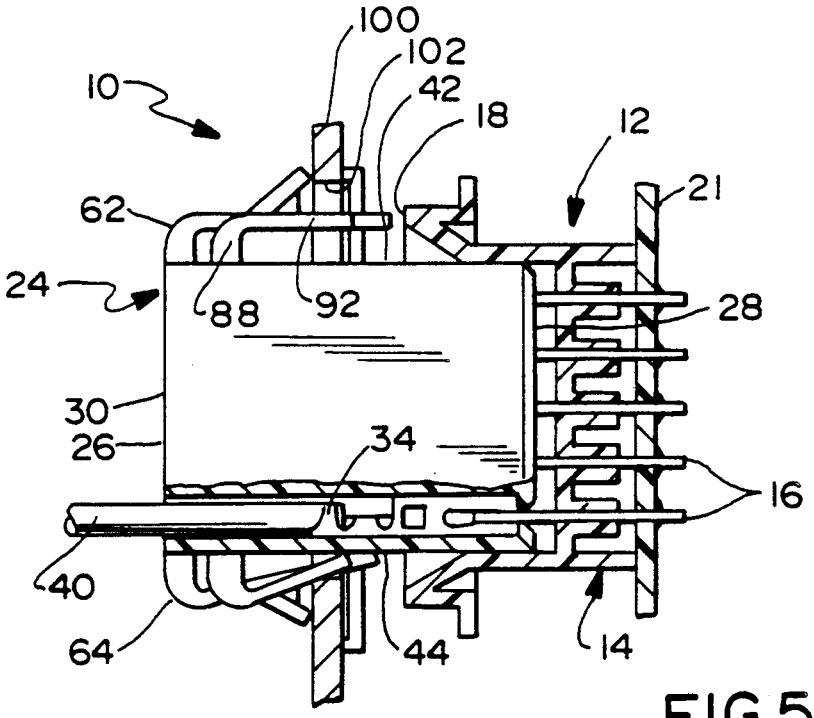
FIG. 5 is a cross-sectional view similar to FIGS. 2 and 3 showing the electrical connector assembly in a fully mated condition.

An electrical connector assembly in accordance with the subject invention is identified generally by the numeral 10 in FIGS. 1-5. As shown most clearly in FIG. 1, the assembly 10 comprises a cluster connector 12 having a molded non-conductive housing 14 and a plurality of spade contacts 16 securely mounted therein. The housing 14 of the cluster connector 12 includes a forward mating end 18 defining a widely flared opening. The spade contacts 16 are recessed from the forwardly facing flared opening which defines the mating end 18 of the housing 14 to ensure proper connector alignment prior to actual mating, as explained further below. The housing 14 further includes a rear end 20 for mounting against a printed circuit board 21 as shown in FIGS. 3-5. The rear end of each spade contact 16 extends beyond the rear end 20 of the housing 14 to extend through holes in the printed circuit board 21, and to thereby enable electrical connection to conductive regions on the circuit board 21. The rear end 20 of the housing 14 is further characterized by standoffs to permit washing of flux and/or application of selected non-conductive coatings to portions of the spade contact 16 extending through the printed circuit board 21. The rear end 20 of the housing 14 is further characterized by ears 22 having mechanical fastening holes, as shown in FIG. 1, for permitting retention of the cluster connector 12 on the printed circuit board.

The connector assembly 10 further includes a floating panel mountable connector 24. The panel mountable connector 24 includes a unitarily molded nonconductive housing 26 having a chamfered forward mating end 28 and a rearward wire receiving end 30. Terminal receiving apertures identified generally by the numeral 32 extend continuously from the forward mating end 28 to the rearward wire receiving end 30 of the housing 26. The apertures 32 are dimensioned and configured to lockingly receive terminals 34 therein.

Each terminal 34 includes a forward mating end 36 configured to mate with a corresponding spade contact 16 in the cluster connector 12. In this regard, preferred spade receiving terminals are shown in copending applications Ser. No. 225,001 and Ser. No. 314,992, the disclosures of which are incorporated herein by reference. Each terminal 34 further includes a rearward crimpable wire mounting end 38 for receiving and electrically connecting to a wire 40. A secondary lock 42 is lockingly engageable in the rear end 30 of the housing 26 to assure proper positioning of the terminals 34 and to provide additional locking assurance to prevent unintended rearward withdrawal of the terminals 34 from the housing 26.

The housing 26 of the floating panel mountable connector 24 is of generally rectangular cross-sectional configuration, and includes opposed substantially parallel top and bottom walls 42 and 44 having a width "a" and first and second opposed parallel side walls 46 and 48 having a height "b". The dimensions "a" and "b" are selected to enable the chamfered mating end 28 of the housing 26 to be received within the flared mating end 18 of the housing 14 of the cluster connector 12. More particularly, the chamfer at the mating end 28 of the housing 26 will engage the outwardly flared portions of the mating end 18 of the housing 14 to generate the ramping forces which cause the float of the electrical connector 24 as explained herein.

The housing 26 is further characterized by a segmented panel engaging flange 50 which extends outwardly from the top and bottom walls 42 and 44 and side walls 46 and 48 by a distance "c" which is selected to prevent the housing 26 from passing entirely through a mounting aperture 102 in a panel 100, as explained below. The flange 50 includes a rearwardly facing panel engaging surface 51. The segmented flange 50 is discontinuous about the periphery of the housing 26, and specifically includes openings 52 and 54 on the top and bottom walls 42 and 44 respectively and openings 56 and 58 at portions of the flange 50 extending from the first and second side walls 46 and 48 respectively. A polarization wall 60 extends rearwardly from the panel mounting flange 50 for engagement with a correspondingly dimensioned slot 104 in the panel 100, as shown in FIG. 2, to ensure properly polarized mounting of the connector 24 to the panel 100.

The housing 26 is further characterized by cantilevered deflectable alignment beam clusters 62, 64, 66 and 68 which are unitarily molded with the housing 26 and extend respectively from the top and bottom walls 42 and 44 and the side walls 46 and 48. The alignment beam clusters are substantially identical. Therefore, to simplify the explanation, only the cluster 62 will be described in detail. More particularly, the cluster 62 is characterized by a deflectable locking beam 70 and a pair of deflectable centering beams 72 and 74. The locking beam 70 in the cluster 62 is disposed intermediate the centering beams 72 and 74.

The locking beam 70 includes a root 76 extending substantially orthogonally from a portion of the housing wall 42 generally adjacent the rear end 30 of the housing 26. A cantilevered portion 78 extends forwardly from the root 76, and is in spaced generally parallel relationship to the associated housing wall 42. The cantilevered portion 78 of the locking beam 70 extends forwardly beyond the panel-engaging flange 50 of the housing 26 a sufficient distance to facilitate engagement of the extreme forward end of the cantilevered portion 78, either manually or with application tooling, to generate inward deflection of the locking beam 70 for removing the connector 10 from the panel 100.

The locking beam 70 is further characterized by a locking projection 80 having a forward locking face 82 and a rearward ramped face 84. The locking face 82 preferably is in spaced relationship to the rearward face 51 of the panel-engaging flange 50. The distance between the forward locking face 82 of the locking projection 80 and the rearward face 51 of the flange 50 is selected to substantially correspond to the thickness of the panel 100 to which the housing 26 is to be mounted as shown in FIGS. 3-5. The ramped rearward face 84 of the locking projection 80 is aligned at an acute angle to the longitudinal direction of the cantilevered portion 78 of the locking beam 78. The ramped rearwardly facing surface 84 is selectively engageable with portions of a panel 100 adjacent to the mounting aperture 102 therein to enable the deflection of the locking beam 70 that is necessary to mount the electrical connector 24 to the panel 100.

The centering beams 72 and 74 also include roots 86 and 88 respectively extending from the associated wall 42 of the housing 26. However, the roots 86 and 88 of the centering beams 72 and 74 are spaced forwardly from the rear face 30 of the housing 26. The centering beams 72 and 74 further include deflectable cantilevered alignment portions 90 and 92 extending forwardly from the roots 86 and 88 respectively to points approximately in line with the panel-engaging flange 50. As shown most clearly in FIGS. 1 and 3, the cantilevered portions 90 and 92 of the centering beams 72 and 74 define a shorter cantilevered length than the locking beam 70. With further reference to FIG. 2, it will be noted that the centering beams extending from the opposed top and bottom walls 42 and 44 define an overall top to bottom cross-sectional dimension "d". A comparable side-to-side dimension defined by the centering beams extending from the opposed side walls 46 and 48 is indicated by dimension "e".

The connector housing 26 is mounted to a panel 100 having a mounting aperture 102 therein. The mounting aperture 102 preferably is substantially rectangular and defines a height which is approximately equal to the height "d" defined by the centering beams extending from the top and bottom walls 42 and 44 of the housing 26. Similarly, the mounting aperture 102 defines a width which is approximately equal to the width "e" defined by the centering beams extending from the opposed side walls 46 and 48 of the housing 26.

The housing 26 is mountable to the panel 100 by urging the housing 26 rearwardly into the mounting aperture 102. This rearward movement of the housing 26 toward the mounting aperture 102 of the panel 100 will enable the root portions 76, 86 and 88 of the deflectable beams 70–74 in each cluster 62–68 to pass through the aperture 102. However, after sufficient rearward movement of the housing 26 into the mounting aperture !02, the rearwardly facing ramped surface 84 of each locking projection 80 will engage portions of the panel 100 adjacent the mounting aperture 102 therein. The rearward forces exerted on the housing 26 will generate ramping forces on the rearwardly facing ramped surfaces 84 to cause the relatively long cantilevered portions 78 of each locking beam 70 to deflect inwardly toward the associated walls 42–48 of the housing 26. This inward deflection of the locking beams 70 will enable continued rearward movement of the housing 26. However, sufficient rearward movement of the housing 26 through the mounting aperture 102 in the panel 100 will cause the forwardly facing locking surface 82 of each locking projection 80 to clear the panel 100. Consequently, the cantilevered portion 78 of each deflectable locking beam 70 will resiliently return toward its undeflected condition. Approximately simultaneously, the panel-engaging flange 50 will engage the panel 100 to prevent any further rearward movement of the housing 26 relative to the panel 100. Thus, the panel will effectively be trapped intermediate the rearward surface 51 of the flange 50 and the forward surface 82 of the locking projection 80 in each cluster 62–68. This trapped engagement of the panel 100 will prevent both forward movement of the housing 26 and rearward movement of the housing 26 relative to the panel 100. Additionally, each of the cantilevered portions 78, 88 and 90 of the beams in each cluster 62–68 will generate centering forces on the panel 100.

The panel mounted electrical connector 24 is mated to the board mounted cluster 12 by moving the panel 100 and/or the circuit board 21 relative to one another in a mating direction as shown sequentially in FIGS. 3–5. It will be appreciated that the illustrated panel and board mounted configurations prevent precise visual alignment of the panel mounted connector 24 to the board mounted cluster connector 12 prior to and during mating. However, the above described and illustrated configuration avoids the possibility of damage to the relatively fragile terminals in the connectors 24 and 12, and further assures the accurate alignment to enable complete mating. More particularly, as shown in FIG. 4, the mating forces generated between the chamfered forward mating end 28 of the housing 26 and the outwardly flared mating end 18 of the cluster connector 12 will cause the connector 24 to float radially in the mounting aperture 102 of the panel 100. More particularly, depending upon the direction of misalignment, the cantilevered portions 78, 90 and 92 of at least one cluster 62–68 will deflect to permit the necessary float. This float generated by the ramping action of the chamfered mating end 28 of the housing 26 and the outwardly flared mating end 18 of the housing 14 will ensure proper alignment of the respective housings 26 and 14 prior to the actual engagement of the relatively fragile terminals 16 and 34. More particularly, the four-sided locking of the panel 100 between the forward surfaces 82 of the locking projections 80 and the rear surface 51 of the flange 50 resists rotation of the connector 24 about any axis in the plane of the panel 100. Thus, the terminals will be properly aligned both radially and axially prior to and during mating.

As noted above, the assembly 10 is specifically designed for periodic disconnection and reconnection. More particularly, after disconnection or unmating, any cantilevered portion 78, 90 and 92 that had been deflected during mating will generate forces on the panel 100 due to the resiliency of the plastic material from which the housing 26 is molded, and will thereby return the housing 26 to its initial centered and rotationally aligned condition relative to the aperture 102 in the panel 100. Furthermore, the provision of three cantilevered beams 70, 72 and 74 in each cluster 62–68 extending from each respective side 42–48 of the housing 26 will cause the housing 26 to both move toward the center of the aperture 102 and to rotationally realign itself with the aperture 102 and about the mating axis.

Periodically it may be necessary or desirable to remove the connector 24 from the panel 100. Such removal can be effected relatively easily from the front of the panel 100 by merely exerting inward biasing forces on the extreme forward ends of the cantilevered portion 78 of each locking beam 70 to deflect each locking beam 70 inwardly a sufficient amount for the locking surface 82 thereof to clear portions of the panel 100 defining the mounting aperture 102. Remounting of the housing 26 can be achieved as described above.

In summary, an electrical connector assembly is provided including at least one panel mountable electrical connector which enables radial float for facilitating blind mating. The connector includes a unitarily molded plastic housing having a generally rectangular cross section. A panel mounting flange extends outwardly from the housing and is dimensioned to engage portions of the panel adjacent a mounting aperture therein. Each wall of the rectangular housing includes a cluster of three deflectable beams. Each cluster includes a centrally disposed locking beam having a locking projection thereon and a pair of centering beams disposed on opposite respective sides of the locking beam. The centering beams and the locking beam all contribute to proper alignment of the housing relative to the panel. The provision of three deflectable beams on each side ensures proper angular alignment of the housing about the mating axis and further ensures proper centering of the connector in the mounting aperture of the panel.

While the invention has been described with respect to a preferred embodiment, it is apparent that various changes can be made without departing from the scope of the invention as defined by the appended claims. In particular, the floatable housing of the subject invention may be employed with any of a variety of terminal or contact configurations. The deflectable beams may extend either forwardly as described herein or rearwardly to enable forward movement of a connector housing during mounting on a panel. The locking projection and the panel mounting flange may take configurations other than those depicted herein. These and other variations will be apparent to a person skilled in this art after having read this disclosure.

We claim:

1. An electrical connector housing for mounting to a panel having opposed first and second faces, a mounting aperture extending through the panel and edges extending between the first and second faces at the mounting aperture, said housing including a forward mating end, a rearward end and side walls extending therebetween, at least one terminal receiving aperture extending through the housing from the forward mating end to the rearward end, said housing defining a cross section for permitting mounting of the housing in the mounting aperture of the panel and for permitting relative float of the housing within the mounting aperture of the panel, wherein the improvement comprises:

a flange extending outwardly from the housing intermediate the forward and rearward ends thereof, said flange being dimensioned to engage portions of the first face of the panel adjacent the mounting aperture; and a cluster of deflectable panel engaging beams extending from each side wall of the housing, each said cluster of deflectable panel engaging beams comprising a locking beam for engaging the second face of the panel adjacent the mounting aperture and a plurality of centering beams for engaging the edges of the panel at the mounting aperture, whereby the panel is lockingly engaged intermediate the flange and the locking beams and whereby the centering beams exert forces on the panel for centering the housing in the mounting aperture.

2. An electrical connector housing as in claim wherein the locking beam of each cluster of panel engaging beams comprises a locking projection extending therefrom for engaging the second face of the panel, and whereby each said cluster includes a pair of centering beams disposed respectively on opposite sides of the locking beam.

3. An electrical connector housing as in claim 2 wherein the locking projection includes a rearwardly facing ramped surface and a forwardly facing locking edge, the ramped surface facilitating inward deflection of the locking beam during mounting of the housing to the panel.

4. An electrical connector housing as in claim 3 wherein the flange is generally planar and wherein the locking surface of each said locking projection is spaced from the plane of the flange by a distance approximately equal to the thickness of the panel.

5. An electrical connector housing as in claim 2 wherein the locking beam is cantilevered forwardly from a portion of the housing substantially adjacent the rearward end thereof, and wherein the centering beams are cantilevered from portions of the housing intermediate the rearward end and the flange.

6. An electrical connector housing as in claim 5 wherein the locking beam includes a forward end disposed forwardly of the flange for facilitating inward deflection of the locking beam and enabling removal of the housing from the panel.

7. An electrical connector housing as in claim 1 wherein the housing is generally rectangular and includes top, bottom and opposed side walls, each of said walls including one of said panel engaging beam clusters thereon.

8. An electrical connector housing as in claim 7 wherein the flange is defined by a plurality of spaced apart flange segments, with each said cluster of panel engaging beams extending intermediate segments of the flange.

9. An electrical connector assembly comprising first and second mateable electrical connectors, said first electrical connector being mountable to a panel having opposed first and second faces and a mounting aperture extending therethrough, said panel further including edges extending between the first and second faces at the mounting aperture, the first and second electrical connectors each including housings, each housing having a forward mating end, an opposed rear end and walls extending therebetween, the first connector being dimensioned to be mounted in the mounting aperture of the panel and to permit relative float in the mounting aperture, wherein the improvement comprises:

the mating end of the second connector housing being flared outwardly; and said first connector housing including a flange extending outwardly from the walls thereof intermediate the forward and rear ends of the first connector housing, said flange being dimensioned to engage portions of the first face of the panel adjacent the mounting aperture therein, said first connector housing further including a plurality of clusters of deflectable panel engaging beams cantilevered forwardly from the side walls of the housing, each said cluster comprising a locking beam having a locking projection disposed on an outwardly facing portion thereof, said locking projection including a forward locking edge for engaging the second face of the panel and a rearward ramped surface for deflecting the locking beam during mounting of the first connector to the panel, each said cluster further including a pair of centering beams disposed respectively on opposite sides of the locking beam of the associated cluster, said centering beams being dimensioned to engage the edges of the panel at the mounting aperture therein, whereby the panel is engageable intermediate the flange and the locking projection for preventing rotation of the first connector about an axis disposed in the plane of the panel, and whereby the centering beams exert centering forces on the panel in response to a float of the first connector relative to the panel.

10. An electrical connector assembly as in claim 9 wherein the forward mating end of the first connector is chamfered, and whereby the chamfered mating end of the first connector is engageable with the flared mating end of the second connector to generate ramping forces for enabling float of the first connector in the mounting aperture and achieving alignment of the first and second connectors during mating.

11. An electrical connector assembly as in claim 9 wherein the first and second connectors are of generally rectangular cross-sectional configuration, said first connector including opposed top and bottom walls and opposed first and second side walls, said clusters of deflectable panel engaging beams being disposed on each of said top and bottom walls and said first and second side walls of the first connector.

12. An electrical connector assembly as in claim 9 wherein each said locking beam is cantilevered from a location on the first connector housing generally adjacent the rear end thereof and extends forwardly to a location forward of the flange for facilitating inward deflection of the locking beams to enable removal of the first connector from the panel.

13. An electrical connector assembly as in claim 12 wherein the centering beams are cantilevered from locations on the first connector housing intermediate the flange and the locations from which the respective locking beams are cantilevered.

14. An electrical connector assembly as in claim 9 wherein the flange is of segmented construction and defines a plurality of spaced apart flange segments, said beam clusters extending intermediate respective segments of said flange.

15. An electrical connector assembly as in claim 9 wherein the first connector housing is unitarily molded from a plastic material.

* * * * *